US006868167B2

(12) United States Patent
Tsuda

(10) Patent No.: US 6,868,167 B2
(45) **Date of Patent: *Mar. 15, 2005**

(54) AUDIO SPEAKER AND METHOD FOR ASSEMBLING AN AUDIO SPEAKER

(75) Inventor: Shiro Tsuda, Asahi (JP)

(73) Assignee: Ferrotec Corporation, Tokyo (JP)

( * ) Notice: Subject to any disclaimer, the term of this patent is extended or adjusted under 35 U.S.C. 154(b) by 219 days.

This patent is subject to a terminal disclaimer.

(21) Appl. No.: 10/172,961

(22) Filed: Jun. 17, 2002

(65) Prior Publication Data

US 2003/0194107 A1 Oct. 16, 2003

Related U.S. Application Data

(63) Continuation-in-part of application No. 10/121,129, filed on Apr. 11, 2002.

(51) Int. Cl.[7] ..... H04R 25/00
(52) U.S. Cl. ..... 381/415; 29/594
(58) Field of Search ..... 381/412, 413, 381/415, 396, 400; 29/594, 602.1, 609.1

(56) References Cited

U.S. PATENT DOCUMENTS 4,019,694 A 4/1977 Fare et al.
4,303,806 A * 12/1981 Thiele ..... 381/410
4,320,263 A 3/1982 Thiele
4,414,437 A * 11/1983 Trauernicht et al. ..... 381/415
4,742,887 A 5/1988 Yamagishi
5,243,662 A 9/1993 Sogn et al.
5,335,287 A 8/1994 Athanas
5,757,946 A 5/1998 Van Schyndel

* cited by examiner

*Primary Examiner*—Suhan Ni
(74) *Attorney, Agent, or Firm*—Robert R. Deleault, Esq.; Mesmer & Deleault, PLLC

(57) ABSTRACT

The method of assembling a speaker includes disposing a quantity of volatile magnetic fluid containing a predetermined amount of lubricating oil into a radial gap of a driver unit, aligning a vibration system having a diaphragm and a voice coil to the driver unit such that the voice coil is movably mounted into the radial gap, fixing the vibration system to the driver unit, and removing the volatile component of the volatile magnetic fluid. The speaker includes a driver unit having a magnetic pole case defining a radial gap, a vibration system having a diaphragm and a voice coil where the vibration system is fixed to the drive unit and the voice coil is movably mounted into the radial gap, and a residual magnetic fluid layer disposed on the surfaces of one or more of the magnetic pole case and the voice coil where an air gap exists between the voice coil and the magnetic pole case.

8 Claims, 2 Drawing Sheets

AUDIO SPEAKER AND METHOD FOR ASSEMBLING AN AUDIO SPEAKER

This application is a continuation-in-part of application Ser. No. 10/121,129, filed Apr. 11, 2002.

BACKGROUND OF THE INVENTION

1. Field of the Invention

The present invention relates generally to an apparatus and method for audio speakers. Particularly, this invention relates to an audio speaker and a method of assembling audio speakers using a liquid suspension mechanism.

2. Description of the Related Art

Conventional speakers commonly comprise a magnet assembly, and a non-magnetic, annular frame extending from the magnet assembly to support the larger end of a cone-shaped diaphragm. The smaller end of the diaphragm cone is attached to a voice coil that extends into an annular magnetic gap provided in the magnet assembly. In order to accurately locate and suspend the voice coil within the magnetic gap, the voice coil is typically attached to the surrounding frame by a corrugated annular suspension.

The voice coil is designed to oscillate axially without experiencing other types of motion such as rotation, moving obliquely to the axial direction, or moving in different directions, at different points, in the oscillation stroke. Should the voice coil scrape on the magnetic gap surfaces, the coil will experience premature failure. One solution is the use of a low volatile, oil-based, magnetic liquid suspension mechanism for locating and suspending the voice coil within the magnetic gap. The oil-based magnetic particle colloid is adhered to the voice coil and to the magnetic gap surfaces since the microscopic magnetic particles are magnetically attracted to the gap surfaces by reason of the permanent magnetic field established across the magnetic gap. The microscopic, i.e. approximately 0.01 micrometers, magnetic particles hold the liquid phase of the colloid in the magnetic gap.

The use of low volatile, oil-based, magnetic fluid in the magnetic gap, however, is not without problems. One problem is the tendency for the liquid to be blown out or drawn out of the magnetic gap during operation, thereby depleting the quantity of liquid in contact with the voice coil. This phenomenon is due to the oscillatory motions of the voice coil, which produces momentary pressure changes in the atmosphere near the end of the pole pieces and in the annular chamber surrounding the pole piece. The use of pressure compensating channels or passageways have been used to prevent this potential blow out problem. Another problem is the added cost of using specially-formulated, low volatile, oil-based magnetic fluids as the locating and suspending mechanism.

Speaker manufacturers have constantly attempted to reduce the size of loudspeakers for use in miniaturized devices such as headphones, hearing aids, cellular phones, etc. U.S. Pat. No. 5,243,662 (1993, Sogn et al.) is one example of these miniature or micro-speaker devices. It discloses a miniaturized electrodynamic sound generator having a diaphragm, a permanent magnet with pole pieces, a magnet yoke, and a coil. The coil is attached to near the margins of the diaphragm and, on the outside of the yoke, the diaphragm is bent down and attached to the outer wall of the yoke.

U.S. Pat. No. 4,742,887 (1988, Yamagishi) discloses an earphone having a housing containing a driver unit. The driver unit includes a magnetic circuit formed by a magnetic plate, a yoke and a magnet, and a vibration system formed of a diaphragm and a voice coil that is accommodated in a gap between the yoke and the magnet. The driver unit extends across the housing adjacent a sound generation opening at the front of the housing so as to divide the interior of the housing into a front cavity and a back cavity.

U.S. Pat. No. 4,320,263 (1982, Thiele) discloses a dynamic electroacoustic transducer having a magnetic pole case defining a magnetic air gap, a coil movably mounted in the air gap and spaced from the magnetic pole case with magnetic liquid extending between the coil and the case in the air gap. A diaphragm is connected to the coil and attached peripherally to the magnetic pole casing so that airtight spaces are defined above and below the coil, which are in communication with each other. The airtight sealing of the spaces prevents the liquid portions of the magnetic liquid from evaporating, which would result in deterioration of the characteristics of the dynamic electroacoustic transducer.

U.S. Pat. No. 5,335,287 (1994, Athanas) discloses a loudspeaker with an oil-based magnetic fluid suspension for the voice coil, instead of the corrugated disk suspension that is conventionally used. Specially designed vent passages are formed in the magnet assembly to prevent internal pressure build-ups, or sub-atmospheric conditions, that could cause the magnetic fluid to be blown out of the magnetic gap.

Due to market-driven cost constraints, manufacturers of micro-speakers for use in cellular phones and other widespread, consumer electronics have designed micro-speakers that do not use the corrugated mechanism for centering and locating the voice coil in the magnetic gap. A magnetic fluid mechanism for centering and locating the voice coil in the magnetic gap of a micro-speaker is also not used because the magnetic fluid reduces, i.e. dampens, the sound pressure too much in these small-sized speakers. Consequently, the voice coil is centered and suspended in the magnetic gap without the use of these two particular centering mechanisms.

The size of the micro-speakers also creates a problem for manufacturers during the assembly process. Currently, manufacturers of micro-speakers experience a micro-speaker rejection rate that is relatively high. One of the reasons for such a rejection rate is that the assembly process is a manually intensive process. The main causes of the failure is breaking of the wire, which has a typical diameter of about 0.008 in. (0.2 mm) to about 0.013 in. (0.33 mm), that attaches to the monolithic coil, deformation of the magnetic pole piece as it is an extremely thin metal plate, and touching of the wire to the yoke when the coil, which is attached to the diaphragm, is inserted into the magnetic gap of the speaker and fixed in place.

Manufacturers of larger speakers known as tweeters and woofers are also concerned with improving speaker performance. One factor that improves speaker performance is to narrow the magnetic gap between the voice coil and the speaker magnets. However, current manufacturing techniques limit the size of the magnetic gap, i.e. how narrow the magnetic gap can be made. This is due to the difficulty in properly centering the voice coil even when using centering fixtures because of the structure of the voice coil itself.

Another problem is that the corrugated disk suspension allows too much lateral movement of the voice coil during use. Consequently, using a narrower radial gap to improve performance would result in the voice coil scraping the edge of the magnetic plate/pole pieces during use causing distortion and premature failure of the speaker.

Therefore, what is needed is an assembly method that allows the voice coil to be easily centered and suspended during the manufacturing process. What is also needed is an assembly method that reduces the manufacturing process rejection rate. What is further needed is an assembly method that is inexpensive to use and whose cost is more than offset by the reduction in the failure rate during micro-speaker production. What is still further needed is an assembly method that allows larger-sized speakers to incorporate a narrower magnetic gap between the voice coil and the magnetic pole pieces/magnetic plate.

SUMMARY OF THE INVENTION

It is an object of the present invention to provide an audio speaker and a method of manufacturing audio speakers that is inexpensive to implement. It is another object of the present invention to provide a method of manufacturing audio speakers that locates and centers the voice coil in the magnetic gap during the assembly of the diaphragm/voice coil assembly to the yoke/driver unit assembly. It is still another object of the present invention to provide a method of manufacturing audio speakers that reduces the failure rate of micro-speakers during micro-speaker production. It is yet another object of the present invention to provide a method of manufacturing audio speakers that permits the use of a narrower magnetic/radial gap for improved performance than is currently used.

The present invention achieves these and other objectives by providing a simple method and mechanism for locating and centering the voice coil of a speaker into the magnetic/radial gap of the driver unit of the speaker during the assembly process. The method includes the step of adding a predetermined amount of a volatile magnetic fluid containing a pre-determined amount of a lubricating fluid to the magnetic/radial gap of the magnetic pole case before inserting the voice coil into the magnetic/radial gap. The volatile magnetic fluid locates and centers the voice coil in the magnetic/radial gap during the assembly process. Once the voice coil and diaphragm are fixed to the support structure of the speaker, the volatile portion of the magnetic fluid is evaporated leaving an air gap between the voice coil and the magnetic pole pieces/magnetic plate of the speaker. Upon evaporation of the volatile carrier liquid, the lubricating oil remains behind with the magnetic particles forming a thin layer of magnetic fluid over the magnetic plate/pole piece surfaces.

Oil-based magnetic fluids typically use a low volatile, relatively high molecular weight, oil-based carrier liquid such as hydrocarbon oil. These oil-based magnetic fluids are used to maintain the voice coil centered within the magnetic gap during assembly and during operation of the speaker. The reason the magnetic fluid is an oil-based magnetic fluid is to prevent the magnetic fluid from undergoing evaporation at room temperature or elevated temperature during and after the assembly process as well as during speaker use. It is a fundamental requirement of using oil-based magnetic fluids in audio speakers that the oil-based magnetic fluid stays within and fills the space, i.e. the radial gap, between the voice coil and the magnetic pole pieces and magnetic plate. Should the oil-based magnetic fluid evaporate, the magnetic fluid would congeal and cause the speaker to fail.

Unlike oil-based magnetic fluids, the volatile magnetic fluid of the present invention is one having a relatively volatile carrier base liquid with a relatively small amount of lubricating oil. The volatile carrier liquid typically is a volatile liquid that is capable of undergoing evaporation at room temperature or at elevated temperatures, unlike the requirements for oil-based carrier liquids. Examples of useful volatile liquids are water and aliphatic hydrocarbon solvents such as octane, heptane and hexane.

The lubricating oil is of a type and quantity such that upon evaporation of the volatile carrier liquid, the remaining magnetic particles and lubricating oil would form an oil-based magnetic fluid film or layer along the surfaces of the magnetic pole case inhibiting the voice coil from touching the magnetic plate and/or pole pieces. The magnetic fluids lubricating ability and magnetic repelling force will cause the voice coil to move toward the center when the voice coil approaches the edge of the magnetic plate. Furthermore, in the event that the voice coil does contact the magnetic fluid layer, the lubricating characteristic of the layer would provide a low friction interface, which would not cause the same level of distortion in speakers without a lubricating layer.

Oil-based carrier liquid magnetic fluids require a high temperature capability because the voice coil's oscillatory movements in the radial gap containing the magnetic fluid is a source of heat generation. Unlike oil-based carrier liquid magnetic fluids, the remaining magnetic fluid of the present invention does not require a high temperature capability. This is so because the voice coil of the present invention is not in constant contact with the magnetic fluid. A light lubricating oil having a 4 cSt (centistoke) or lower viscosity at 100° C. is used as compared to the oil-based carrier fluids that typically use oil having 6 cSt or higher viscosity at 100° C. The types of oils that can be used as the light lubricating oil, for example, are hydrocarbon, ester, ether, perfluorocarbon, and silicone.

Generally, the saturation magnetization is as low as possible for use as a voice coil centering mechanism for a given speaker configuration so as not to form a thick residual layer of magnetic particles and lubricating oil on the surface of the magnetic pole case. In addition, the volume percent of lubricating oil used in the volatile magnetic fluid is inversely proportional to the saturation magnetization of the remaining fluid after evaporation of the volatile carrier liquid. This is so because the lower the volume percent of the lubricating oil to the total volume of the volatile magnetic fluid plus the lubricating oil, the higher the concentration of magnetic particles to the volume of lubricating oil remaining after evaporation of the volatile carrier liquid. The range of the initial saturation magnetization of the volatile magnetic fluid and the amount of the lubricating oil used is application dependent. In other words, it is dependent on the type of speaker, the size of the magnetic gap, and the size of the voice coil.

The method of the present invention involves obtaining a volatile magnetic fluid and adding a predetermined amount of lubricating oil to the volatile magnetic fluid. The volatile magnetic fluid and lubricating oil mixture is then added to the magnetic/radial gap of the speaker. The volatile magnetic fluid may be added using a dispenser or by dipping a solid needle rod or a hollow rod (i.e. capillary tube) into the magnetic fluid and locating the solid rod, the hollow rod or the dispenser close to the magnetic gap. The wetting ability of the ferrofluid and the magnetic force field of the driver unit cause the volatile magnetic fluid to fill the magnetic gap of the speaker. The voice coil of the diaphragm/voice coil assembly is then positioned over the centrally located yoke, i.e. magnetic pole piece, and the voice coil is inserted into the magnetic gap. The volatile magnetic fluid will become disposed around the voice coil causing the voice coil to be located and centered within the magnetic gap. The diaphragm/voice coil assembly can then be secured into position. Once secured, the volatile magnetic fluid is evaporated leaving a thin film/layer of lubricating oil containing magnetic particles disposed about the surface of the magnetic plate and magnetic pole pieces and the voice coil suspended within the magnetic gap. The remaining mixture of lubricating oil and magnetic particles is itself a lower viscosity oil-based magnetic fluid. It has the characteristic of forming a thin film or layer along the surface of the magnetic plate and pole pieces due to the magnetic force field, yet is sufficient to keep the magnetic particles suspended within the magnetic fluid film.

DETAILED DESCRIPTION OF THE PREFERRED EMBODIMENT

Figure 1:
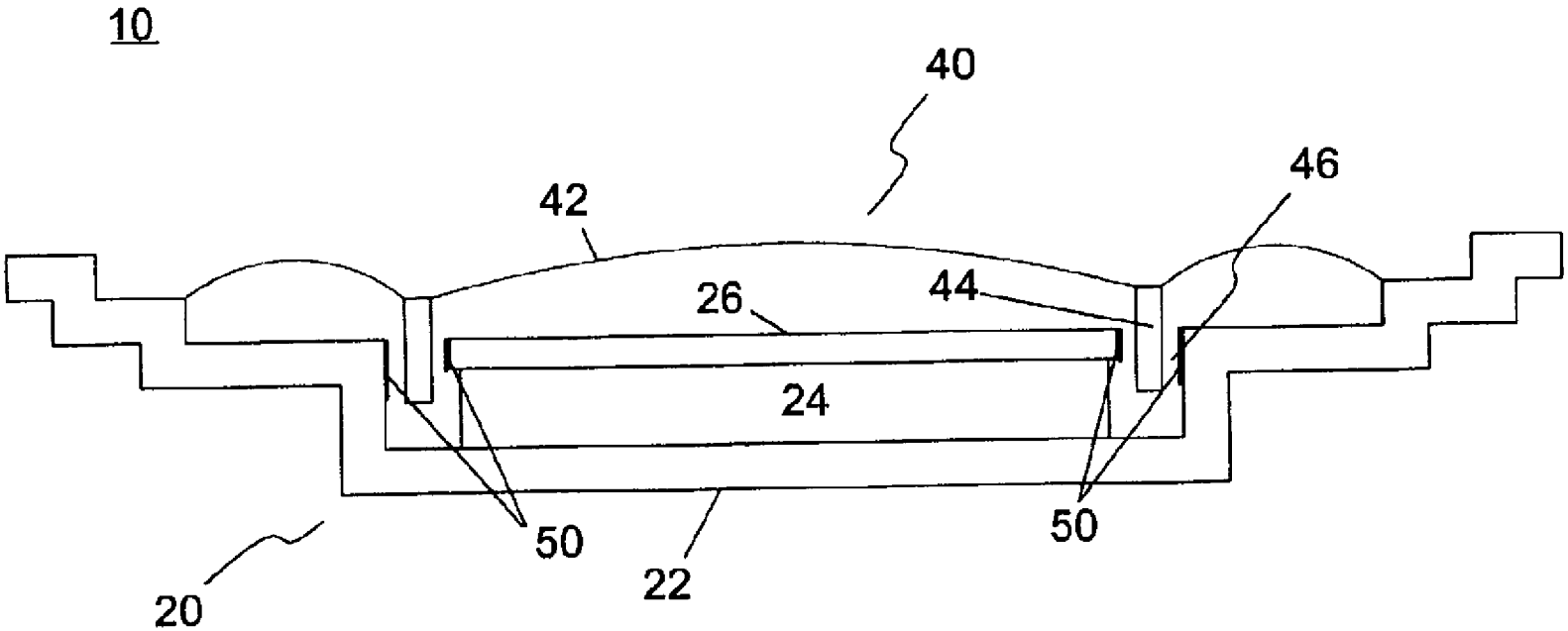
FIG. 1 is a simplified cross-sectional view of a speaker.

The preferred embodiment of the present invention is illustrated in FIGS. 1–5. Now turning to FIG. 1, there is shown a simplified cross section of a speaker 10. Speaker 10 includes a driver unit 20 and a vibration system 40. Driver unit 20 includes a magnetic circuit formed by a support frame or yoke 22, a magnet 24, and a magnetic plate 26. Vibration system 40 is formed of and includes a diaphragm 42 and a voice coil 44. Voice coil 44 is movably mounted in a radial gap 46 formed by yoke 22, magnet 24 and magnetic plate 26. Voice coil 44 and radial gap 46 have a residual layer 50 on various surfaces, typically the magnetic plate/pole pieces, caused by the evaporation of the volatile base carrier liquid of a volatile magnetic fluid used in the assembly of speaker 10. Residual layer 50 is composed of a light lubricating oil containing a suspension of magnetic particles.

Speaker 10 may be a low profile speaker typically for use in cellular phones and the like or a speaker typically known as a tweeter or a woofer and the like. For a better understanding of the importance of the present invention, a listing of typical dimensions of a currently available micro-speaker is provided. Magnetic plate 26 is in the shape of a disk having a diameter of about 7.9 mm with a thickness of about 0.4 mm. Magnet 24 is also disk-shaped having a diameter of about 7.4 mm with a thickness of about 0.6 mm. Support frame or yoke 22 forms a housing for magnet 24 and magnetic plate 26 that provides a radial gap 46 of about 0.75 mm. The radial gap volume is about 8.15 $mm^3$. Voice coil 44 has an internal diameter of about 8.3 mm with an outer diameter of about 8.7 mm forming a voice coil volume in radial gap 46 of about 2.14 $mm^3$.

From the above-described, typical dimensions for a micro-speaker, it is understandable that speaker manufacturers have a relatively high rejection rate in manufacturing. The close specifications of the voice coil 44 within radial gap 46 and the size of micro-speaker 10 makes handling of driver unit 20 and vibration system 40 difficult and tedious. This causes breaking of the wires that attach to voice coil 44, deformation of magnetic plate 26, and/or contacting of the voice coil 44 to the yoke 22 when vibration system 40 is assembled to driver unit 20.

The present invention provides a method for locating and centering voice coil 44 within radial gap 46 during the speaker assembly process. The method of the present invention includes the use of a volatile magnetic fluid containing a pre-determined amount of lubricating oil. The volatile magnetic fluid generally comprises a volatile carrier liquid or base liquid, a plurality of magnetic particles, a dispersant for dispersing the plurality of magnetic particles in the volatile carrier liquid, and a pre-determined amount of lubricating oil. Some useful carrier liquids are water and aliphatic hydrocarbons such as hexane, heptane and octane. Any conventional magnetic fluid based on volatile liquids as the carrier liquid may be used and the formulations of such volatile magnetic fluids are within the knowledge of one of ordinary skill in the art. Although aromatic hydrocarbon and other polar solvents may be used as the volatile base carrier liquid, it is hypothesized that use of these types of liquids may affect the integrity of adhesives used, if any, in the speaker assembly process.

The lubricating oils useful in the present invention are oils such as hydrocarbon, ester, ether, perfluorocarbon, and silicone. The preferred oil is a hydrocarbon oil including petroleum and synthetic hydrocarbons. Among such hydrocarbons, aromatic hydrocarbons may be more reactive with other materials used in a speaker than aliphatic hydrocarbons. Parafinic, naphthenic and poly alpha olefin may be preferable. Poly alpha olefin being the most preferable for its characteristic low pour point, low viscosity, low volatility, and inertness. In addition, where poly alpha olefins used in conventional magnetic fluids for damping and heat transfer purposes have 6 cSt or higher viscosity at 100° C., it is preferable to use lower molecular weight poly alpha olefins (less than 6 cSt), preferably 4 cSt or lower. This is so because the high molecular weight poly alpha olefins need a second large dispersant on the magnetic particles to disperse the magnetic particles within the higher molecular weight poly alpha olefins. The higher molecular weight poly alpha olefins are less preferred because the second large dispersant generates a larger volume of residual particles, which leaves a thicker residual layer after evaporation of the volatile carrier liquid.

The use of oil-based magnetic fluids in the prior art requires that the oil-based fluid is always touching the coil and the magnetic plate/pole pieces forming a magnetic fluid O-ring seal. Unlike the prior art, the residual magnetic fluid layer of the present invention that remains after evaporation of the volatile carrier liquid should be as thin as possible and should not form a magnetic fluid O-ring seal. Thus, the amount of lubricating oil in the solvent-based magnetic fluid should be no more than fifty volume percent (50 vol. %) of the total volume of the initial solvent-based magnetic fluid plus the lubricating oil. The smaller the volume percent of lubricating oil, the thinner the residual layer. The following Table shows the typical saturation magnetization of the remaining magnetic fluid after evaporation of the volatile carrier liquid.

TABLE 1

| | Saturation Magnetization (Ms) After Evaporation of Volatile Carrier Liquid | |
|---|---|---|
| Vol. % of oil | Initial Ms = 100 G | Initial Ms = 200 G |
| 50 | 200 | 400 |
| 25 | 400 | 800 |
| 12.5 | 800 | |

It is believed that the remaining magnetic fluid after evaporation of the volatile carrier liquid may have a saturation magnetization of up to 1,000 G. However, the viscosity of the remaining magnetic fluid having saturation magnetization above 1,000 G is considered too high for optimal use in the present invention.

The quantity of magnetic particles per unit volume of magnetic fluid is represented by the magnetic fluid's saturation magnetization and it is measured in Gauss. A low saturation magnetization fluid tends to leave a thinner residual layer of magnetic particles than a magnetic fluid with a higher saturation magnetization. However, either one may be used depending on the manufacturing procedure used. Using a magnetic fluid with a low saturation magnetization allows for filling of the magnetic gap with the fluid for centering the voice coil, but may require the fixing of the diaphragm either temporarily or at intermittent locations so as to provide a means for the volatile liquid vapor to escape from the radial gap. Those skilled in the art of speaker assembly are better able to determine without undue experimentation the most economical assembly procedure for using the method of the present invention with a volatile magnetic fluid having a low saturation magnetization.

Using a magnetic fluid with a higher saturation magnetization allows for incomplete filing of the radial gap forming an incomplete liquid O-ring with air passages but provides a stronger magnetic centering force. The air passages would act as a conduit allowing the volatile liquid vapor of the magnetic fluid to escape the radial gap. Preferably, the saturation magnetization range for use in the present invention is kept reasonably low so as not to form a relatively thick residual layer of lubricating oil/magnetic particles on voice coil 44 and/or magnetic plate 26. It should be understood that the proper saturation magnetization for a given volatile magnetic fluid composition will be dependent on a variety of factors including the type of carrier liquid used as the base volatile liquid in the volatile magnetic fluid, the size of the speakers, the size of the radial gap, the clearances between the voice coil and the radial gap, etc.

Residual layer 50 of the present invention also provides distinct advantages over the conventional requirements in the manufacturing process of speakers such as tweeters and woofers. The use of the volatile magnetic fluid containing a pre-determined amount of lubricating oil of the present invention allows the manufacture of speakers such as tweeters and woofers with smaller radial gaps than is conventionally used in the manufacture of these types of speakers. The smaller radial gap provides improved speaker performance while the remaining lubricating oil-based magnetic fluid provides a magnetic fluid layer along the surfaces of the magnetic plate/pole pieces of the radial gap. The magnetic fluid layer further provides the lubrication necessary to reduce distortion effects caused by scraping of the voice coil along the radial gap surfaces that can arbitrarily occur during speaker use.

Figure 2:
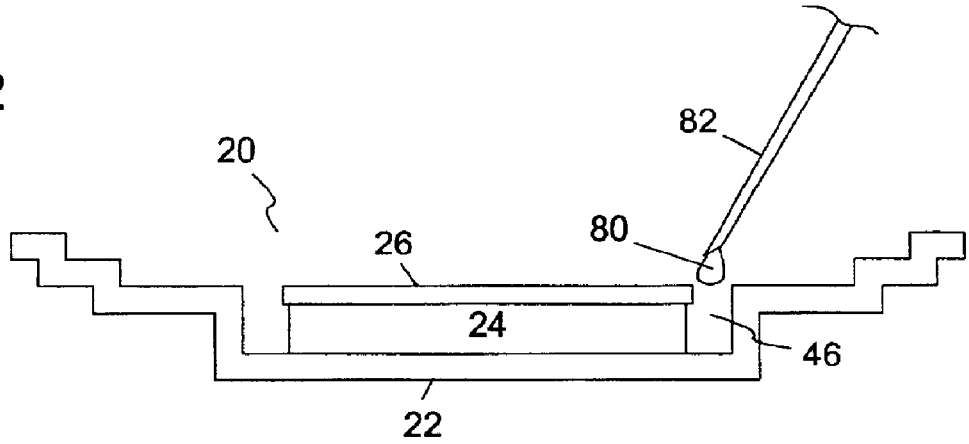
FIG. 2 is a simplified cross-sectional view of the support structure of a speaker.

Turning now to FIGS. 2–5, there is shown the method of the present invention with a micro-speaker. It should be understood that the method is similar for larger type speakers such as tweeters and woofers. FIG. 2 illustrates the driver unit 20 of a microspeaker 10 having a magnetic circuit formed by a support frame or yoke 22, a magnet 24, and a magnetic plate 26. A predetermined amount, typically only a few microliters or less, of volatile magnetic fluid 80 is added to the radial gap 46. Magnetic fluid 80 may be added using a dispenser with a needle-shaped tip 82 or by simply dipping a properly-sized needle rod into the bulk magnetic fluid and then locating the needle rod having a drop or droplet on the rod's tip close to radial gap 46, transferring the drop or droplet of volatile magnetic fluid to radial gap 46. It is noted that a properly sized capillary tube may be substituted for the needle rod.

Figure 3:
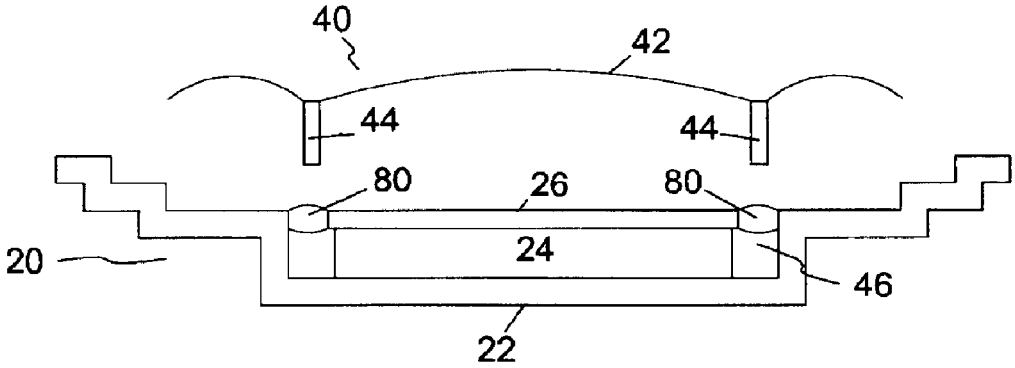
FIG. 3 is a simplified cross-sectional view of the support structure of a speaker with the volatile magnetic fluid in the magnetic gap.
Figure 4:
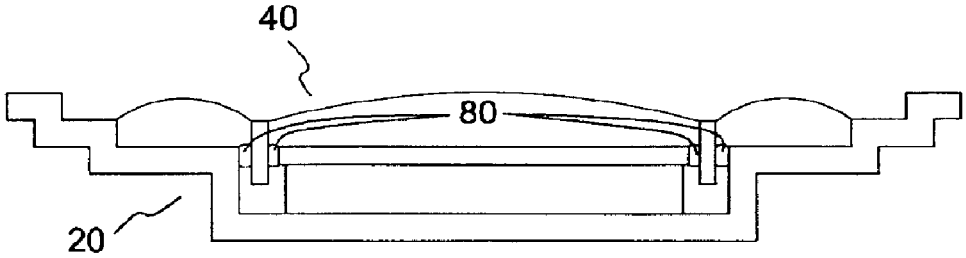
FIG. 4 is a simplified cross-sectional view of an assembled speaker with the volatile magnetic fluid in the magnetic gap around the voice coil.

FIG. 3 illustrates the location of the volatile magnetic fluid 80 in the radial gap 46. Vibration system 40 having diaphragm 42 and voice coil 44 is positioned over drive unit 20 such that voice coil 44 is aligned with radial gap 46 formed by yoke 22, magnet 24 and magnetic plate 26. Once aligned, vibration system 40 is placed into position. FIG. 4 illustrates vibration system 40 positioned into drive unit 20. Volatile magnetic fluid 80, because of the magnetic force field established by magnet 24 with yoke 22 and magnetic plate 26, locates and centers voice coil 44 in radial gap 46. Vibration system 40 is now fixed in position to driver unit 20.

Figure 5:
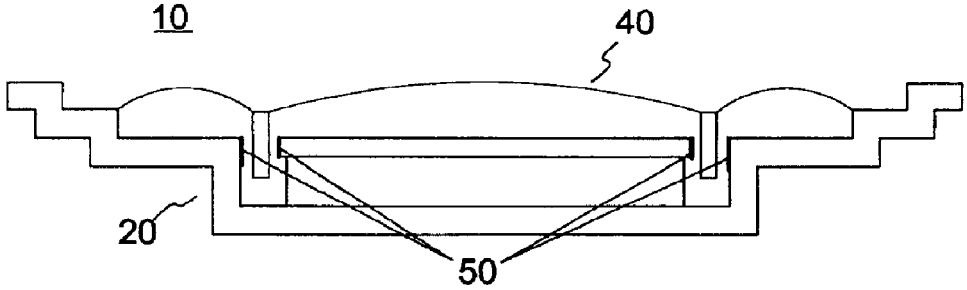
FIG. 5 is a simplified cross-sectional view of an assembled speaker after the volatile magnetic fluid in the magnetic gap has been evaporated.

After vibration system 40 is fixed in position to driver unit 20, volatile magnetic fluid 80 is evaporated from microspeaker 10 as shown in FIG. 5. Although the volatile base carrier liquid is evaporated, residual layer 50 is left behind on the surfaces of radial gap 46. Residual layer 50 comprises the plurality of magnetic particles dispersed in the lubricating oil from the evaporated volatile magnetic fluid.

Tests were performed on representative samples of magnetic fluids without lubricating oil to determine the approximate amount of magnetic particles that would be left behind after evaporation. Two types of magnetic fluids using heptane as the volatile carrier liquid were prepared. The preparation of these magnetic fluids were prepared in the conventional manner known by those of ordinary skill in the art. In the first example, oleic acid was used as the dispersant and the excess amount of the oleic acid was removed. In the second example, oleic acid was used as the dispersant and some of the excess oleic acid (about 5 vol. %) was left in the magnetic fluid. Each type of magnetic fluid was separated into various samples and the saturation magnetization for each sample was adjusted. The collection of samples represented magnetic fluid of each type having a saturation magnetization of 50, 100, 200, and 400 Gauss.

A test fixture was prepared that consisted of a magnetic housing, a magnet, a spacer, a sleeve, and a top magnetic plate. The test fixture was similar to a dome tweeter speaker without the coil or diaphragm. The radial gap volume for the test fixture was about 116 $mm^3$. Each kind of magnetic fluid having the different saturation magnetization values was injected into the radial gap of the test fixture. A volume of about 120 $mm^3$ was injected for each test. The volatile base carrier liquid was removed by evaporation and the condition of the residual magnetic particles in the radial gap was observed.

The 100 Gauss magnetic fluid having the oleic acid dispersant/surfactant and containing no excess dispersant/surfactant formed about 0.09 mm of residual layer outside of the magnetic plate 26 and about 0 mm to about 0.01 mm of residual layer in the inside of the radial gap 46. The residual layer appeared crisp, cracked and not sticky. The 100 Gauss magnetic fluid having the oleic acid dispersant and containing about 5 vol. % of excess of the oleic acid dispersant/surfactant to the volume of ferrofluid formed about 0.25 mm of residual layer outside of the magnetic plate 26 and about 0 to about 0.01 mm of residual layer in the inside of the radial gap 46. The residual layer appeared very sticky. The results tend to indicate that the surfactant used to disperse the plurality of magnetic particles in the volatile base carrier liquid is preferably one having a relatively short molecular tail like that of oleic acid with the excess surfactant preferably removed from the magnetic fluid. The results also indicate that the addition of lubricating oil to the volatile magnetic fluid in the quantities discussed earlier will prevent the development of a sticky residual layer or a dry, crisp residual layer, of which either could interfere with voice coil oscillatory movements causing distortion or speaker failure.

Even though the radial gap volume of the test fixture was approximately 14 times larger than the radial gap volume in a micro-speaker, it is expected that the volume of magnetic fluid used and the resulting residual layer of magnetic particles will also be proportionally less than was observed with the test fixture using comparable Gauss-valued, volatile magnetic fluids, and likely less because the radial gap of the micro-speaker is likely less than the radial gap of a dome tweeter speaker and because the volume taken up by the voice coil will also reduce the amount of volatile fluid left in the radial gap before the evaporation step.

The residual layer 50 of the present invention also provides distinct advantages over the conventional requirements in the manufacturing process of speakers such as tweeters and woofers. The use of volatile magnetic fluid 80 enables manufacturers to use narrower radial gaps to improve speaker performance. Residual layer 50 provides a lubricating layer upon which the voice coil may slide in the event that the voice coil comes in contact with the magnetic plate/pole pieces during use. Because the voice coil is able to slide along the residual layer 50, less distortion of sound from the speaker is experienced.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A method of assembling a vibration system to a driver unit of a speaker, said method comprising:

disposing a predetermined amount of a volatile magnetic fluid containing a volatile base carrier liquid and a pre-determined amount of lubricating oil into a radial gap of said driver unit;

aligning said vibration system with said driver unit wherein a voice coil of said vibration system is movably mounted into said radial gap;

fixing said vibration system to said driver unit; and evaporating said volatile base carrier liquid from said volatile magnetic fluid.

2. The method of claim 1 further comprising formulating said volatile magnetic fluid.

3. The method of claim 2 wherein said formulating stop further includes obtaining a plurality of magnetic particles, suspending said plurality of magnetic particles in said volatile base carrier liquid, adding a sufficient amount of dispersing agent to said volatile base carrier liquid to disperse said plurality of magnetic particles in said carrier liquid, and adding a pre-determined amount of lubricating oil.

4. The method of claim 3 further comprising removing the excess dispersing agent from said carrier liquid.

5. The method of claim 3 wherein said step of adding said lubricating oil further includes adding a quantity of lubricating oil wherein said quantity is less than or equal to fifty volume percent of said volatile magnetic fluid.

6. The method of claim 3 wherein said step of adding said lubricating oil further includes adding one of a hydrocarbon, ester, ether, perfluorocarbon or silicone lubricating oil.

7. The method of claim 3 wherein said step of adding said lubricating oil further includes adding lubricating oil having a viscosity of less than six centistakes at 100° C.

8. A method of assembling a vibration system of a speaker to a driver unit of said speaker, said method comprising:

disposing a quantity of volatile magnetic fluid containing a pre-determined amount of lubricating oil into a radial gap of said driver unit;

aligning said vibration system with said driver unit wherein a voice coil of said vibration system is movably mounted into said radial gap;

fixing said vibration system to said driver unit; and evaporating substantially all of a volatile component of said volatile magnetic fluid from said radial gap.

* * * * *